US008522792B2

(12) United States Patent
Wan

(10) Patent No.: US 8,522,792 B2
(45) Date of Patent: Sep. 3, 2013

(54) SMOKING CESSATION TOBACCO PIPE

(76) Inventor: Liangchuan Wan, Wuhan (CN)

( * ) Notice: Subject to any disclaimer, the term of this patent is extended or adjusted under 35 U.S.C. 154(b) by 139 days.

(21) Appl. No.: 13/265,866

(22) PCT Filed: Apr. 22, 2010

(86) PCT No.: PCT/CN2010/000555

§ 371 (c)(1),
(2), (4) Date: Oct. 22, 2011

(87) PCT Pub. No.: WO2010/121493

PCT Pub. Date: Oct. 28, 2010

(65) Prior Publication Data

US 2012/0037170 A1 Feb. 16, 2012

(30) Foreign Application Priority Data

Apr. 23, 2009 (CN) ..... 2009 2 0149897 U

(51) Int. Cl.
*A24F 1/32* (2006.01)
*A24F 3/00* (2006.01)
*A24F 47/00* (2006.01)

(52) U.S. Cl.
USPC ..... 131/270; 131/329; 131/330

(58) Field of Classification Search
USPC ..... 131/270–273
See application file for complete search history.

(56) References Cited

U.S. PATENT DOCUMENTS 4,854,332 A * 8/1989 Hanakura ..... 131/365

FOREIGN PATENT DOCUMENTS

CN 2424641 * 10/1999

* cited by examiner

*Primary Examiner* — Richard Crispino
*Assistant Examiner* — Eric Yaary
(74) *Attorney, Agent, or Firm* — Houtteman Law LLC

(57) ABSTRACT

A smoking cessation tobacco pipe helps smokers to fully and directly realize the harm of tobacco to a human body when they are smoking and give up smoking and publicize smoking cessation. The tobacco pipe is a transparency which is assembled with a top cover part (2) integrated with a smoke-inlet pipe (3) and a smoke-outlet pipe (4), a box body part (1), a bottom cover part (6) and a smoking pipe part (5), wherein the smoke-outlet pipe (4) is connected with the smoking pipe part (5), and when in use the tobacco is placed at the opening of the smoke-inlet pipe (3). A series of tiny holes are provided on the smog route from the smoke-inlet pipe (3) to the smoke-outlet pipe (4), where the tiny holes are arranged and assembled to form warning characters or patterns, which warn that smoking is harmful to health. The characters and patterns are strengthened due to the adhesive attachment of smoke. The smokers are warned when the smokers are smoking, so that the smokers can reduce the intake of harmful ingredients like tar. The assembly smoking cessation tobacco pipe with tiny holes can accomplish the purpose of helping smokers to give up smoking and publicizing smoking cessation.

9 Claims, 4 Drawing Sheets

SMOKING CESSATION TOBACCO PIPE

FIELD OF TECHNOLOGY

The present invention relates to a smoking cessation tobacco pipe, more particularly to a product helping smoking cessation and publicizing smoking cessation.

1. Background of Technology

Smoking is harmful to health. Generally, a tobacco pipe is used for smoking. The only purpose for using the tobacco pipe is for smoking, and the smokers can not fully realize the harm of tobacco to a human body when they are smoking.

2. Disclosure of Invention

To overcome that the existing tobacco pipes can not fully and directly express the harm of smoking, the present invention provides a smoking cessation tobacco pipe, which makes smokers to fully and directly realize the harm of tobacco to a human body when they are smoking and has the function of helping to give up smoking and publicize smoking cessation.

The technical solutions of the present invention to solve the technical problems are as follows.

According to an embodiment of the present invention, a smoking cessation tobacco pipe is provided, the whole of which is a transparency which is assembled with a top cover part integrated with a smoke-inlet pipe and a smoke-outlet pipe, a box body part, a bottom cover part and a smoking pipe part, wherein the smoke-outlet pipe is connected with the smoking pipe part, and when in use the tobacco is placed at the opening of the smoke-inlet pipe characterized in: in the box body part, a series of tiny holes are provided on the smog route from the smoke-inlet pipe to the smoke-outlet pipe, where the tiny holes are arranged and assembled to form warning characters or patterns, which warning that smoking is harmful to health.

According to an embodiment of the present invention, a convex lens and a pattern of human's lung are provided in the box body part.

According to an embodiment of the present invention, the said tiny holes are provided on the smoke-inlet pipe or the smoke-outlet pipe.

According to an embodiment of the present invention, there is an interlayer in the box body, the said tiny holes are provided on the said interlayer.

According to an embodiment of the present invention, there is an interlayer provided in the box body, with a convex lens and a pattern of human's lung provided on the said interlayer.

According to an embodiment of the present invention, the top cover part of the tobacco pipe is provided with a convex lens and a pattern of human's lung.

According to an embodiment of the present invention, the bottom cover part of the tobacco pipe is provided with a convex lens and a pattern of human's lung.

According to an embodiment of the present invention, the said tiny holes are either independent to each other or connected to form hollowed-out warning characters or hollowed-out warning patterns, which warning that smoking is harmful to health.

According to an embodiment of the present invention, the said tiny holes may be directly integrated, or may be formed by clearance fit between the parts.

Smoke smog is a fluid, and fluid has the property that it can adhere to the surface of a solid which contacts with it and moves relative to it. Various fluid, such as water, air, oil, all of them have adhesive, however the value of adhesive of them is different (referring to Page 807 of Physics fascicule of Chinese Encyclopaedia). As well-known, there are many harmful ingredients such as tar in smoke smog. After smoking 1-2 cigarette(s) by using the present invention, there will be many yellow-black tar spots adhered to the internal walls of the box body part, by a convex lens provided on the box body part, the smokers will more clearly view this phenomena, and a lung pattern provided on the box body part will make the smokers directly associate that the harmful ingredients of cigarette are adhering and depositing in their lungs. Thus, the warning effect which warning that smoking is harmful to health is achieved.

Moreover, in the tobacco pipe, a series of tiny holes are provided on the smoke-inlet pipe, or the smoke-outlet pipe, or the interlayer. The flow rate of smoke smog changes when it passes through the tiny holes, the adhesive rises and the tar aggregating phenomena is more obvious. Thus, the smokers further discren that smoking is harmful to health. Particularly when such series of tiny holes are arranged and assembled to form warning characters or patterns, which warning that smoking is harmful to health, and the smoke smog dyes the arranged characters or patterns to yellow-black tar characters or tar patterns. The warning effect which warns that smoking is harmful to health will be more explicit and more obvious.

By the above mentioned solutions, the present invention reduces the intake of harmful ingredients such as the tar in a physical way, and also warns the smokers that smoking is harmful to health in vision and mentality. Thus, the effect that making the smokers to fully and directly realize the harm of tobacco to a human body when they are smoking and the function of helping them to give up smoking and publicize smoking cessation is achieved.

The effect of present invention is that it makes the smokers to fully and directly realize the harm of tobacco to a human body when they are smoking and it has the function of helping them to give up smoking and publicize smoking cessation.

Each part of the assembly smoking cessation tobacco pipe with tiny holes may be made of innocuous plastic and be assembled together. After disconnecting, it can be conveniently put into a hollow cigarette box for conveniently carrying it.

DESCRIPTION OF DRAWINGS

The invention will be described referring to the drawings and recommendatory embodiments.

EMBODIMENTS

Hereafter the details of the embodiments of the present invention will be described referring to the FIG. 1-7.

Figure 1:
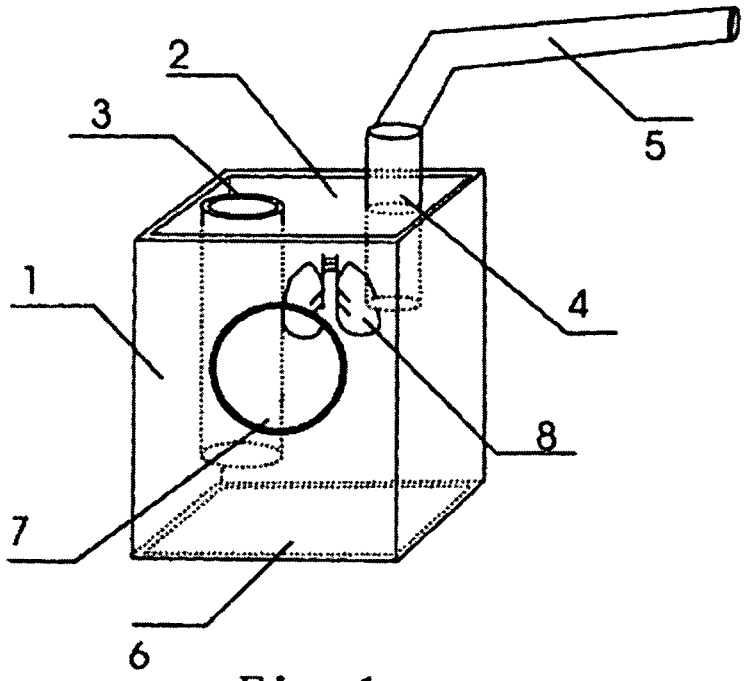
FIG. 1 is the perspective schematic diagram of the integral structure of the first recommendatory embodiment according to the present invention.

As shown in FIG. 1, the said assembly smoking cessation tobacco pipe with tiny holes comprises a box body part 1, a top cover part 2, a smoke-inlet pipe 3, a smoke-outlet pipe 4, a smoking pipe part 5, a bottom cover part 6, a convex lens 7 and a human lung's pattern 8. The assembly smoking cessation tobacco pipe with tiny holes may be made of transparent and innocuous material, such as transparent and innocuous plastic. The top cover part 2, the smoke-inlet pipe 3, and the smoke-outlet pipe 4 may be integrated together, for example, which is formed by an injection molding machine. The convex lens 7 and the human lung's pattern 8 is corresponded to each other and respectively provided on an opposite face of the box body part 1. The box body part 1 with the convex lens 7 and the human lung's pattern 8 may also be formed by the injection molding machine. In use, a cigarette is placed at the opening of the smoke-inlet pipe 3, and the smoker holds the smoking pipe part 5 between his lips to smoke. Smoke smog comes into the box body part 1 from the smoke-inlet pipe 3, and comes into the human body through the smoke-outlet pipe 4 and the smoking pipe part 5. Because there are much harmful ingredients such as tar in smoke smog, after having smoken 1-2 cigarette(s) with the present invention, there will be many yellow-black tar spots adhered to the internal walls of the transparent box body part 1, by the amplifying of the convex lens 7 provided on the box body part, the smokers will more clearly discern this phenomena, and the lung pattern 8 provided on the box body part will make the smokers directly associating the harmful ingredients of the cigarette are adhering and depositing in their lungs. Thus, the warning effect which warns that smoking is harmful to health is achieved.

Figure 2:
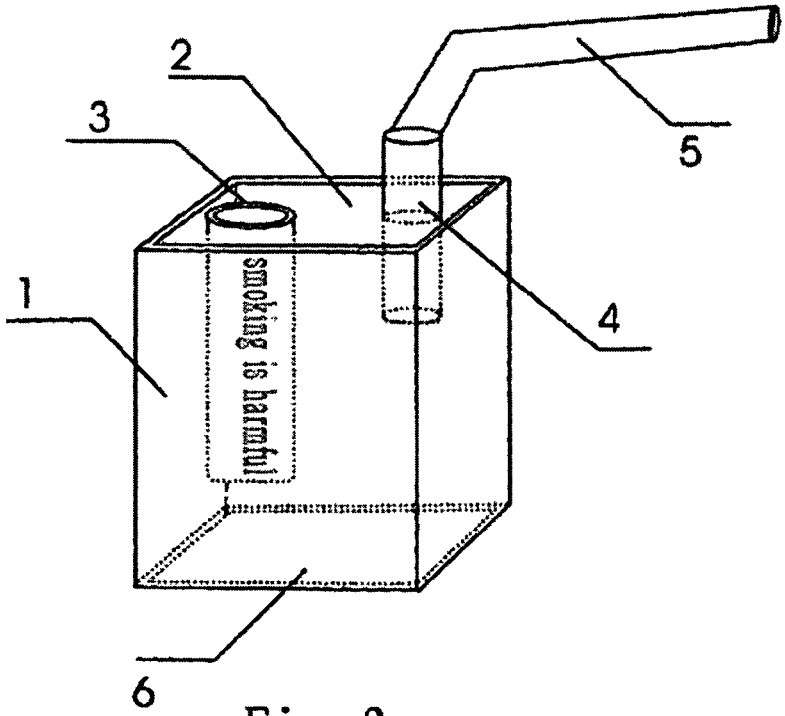
FIG. 2 is the perspective schematic diagram of the integral structure of the second recommendatory embodiment according to the present invention.

In the embodiment shown in FIG. 2, a series of tiny holes are provided on the smoke-inlet pipe 3. The flow rate of smoke smog changes when it passes through the tiny holes, the adhesive rises and the tar aggregating phenomena is more obvious. Thus, the smokers will further discern that smoking is harmful to health. Particularly when such series of tiny holes are arranged and assembled to form warning characters or patterns, which warn that smoking is harmful to health, the smoke smog dyes the arranged characters or patterns to yellow-black tar characters or patterns. The warning effect which warns that smoking is harmful to health is more explicit and more obvious. The present invention reduces the intake of harmful ingredients such as tar in a physical way, and warns the smokers that smoking is harmful to health in vision and mentality way. Thus, the effect that making the smokers to fully and directly realize the harm of tobacco to the human body when they are smoking and the function of helping them to give up smoking and publicize smoking cessation can be achieved.

Figure 3:
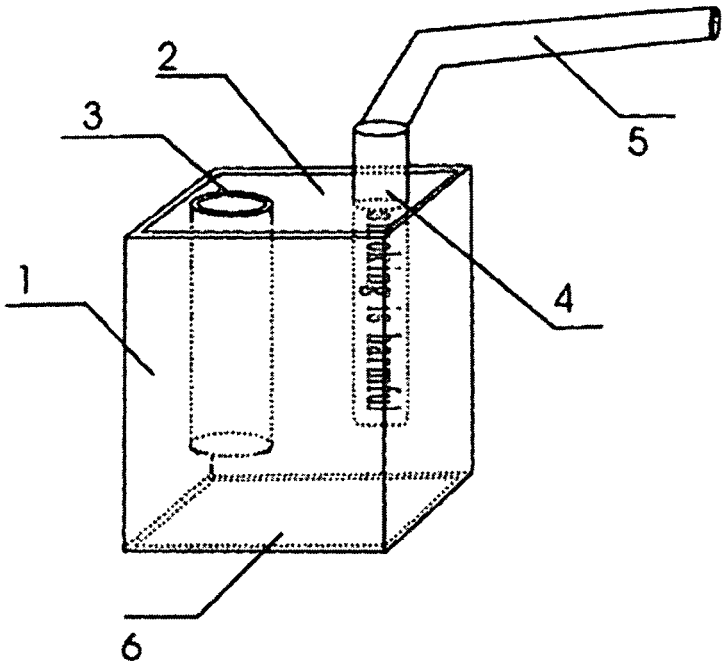
FIG. 3 is the perspective schematic diagram of the integral structure of the third recommendatory embodiment according to the present invention.

In the embodiment shown in FIG. 3, the series of tiny holes provided on the smoke-inlet pipe 3 are changed to be provided on the smoke-outlet pipe 4 instead, and herein the description is omitted.

Figure 4:
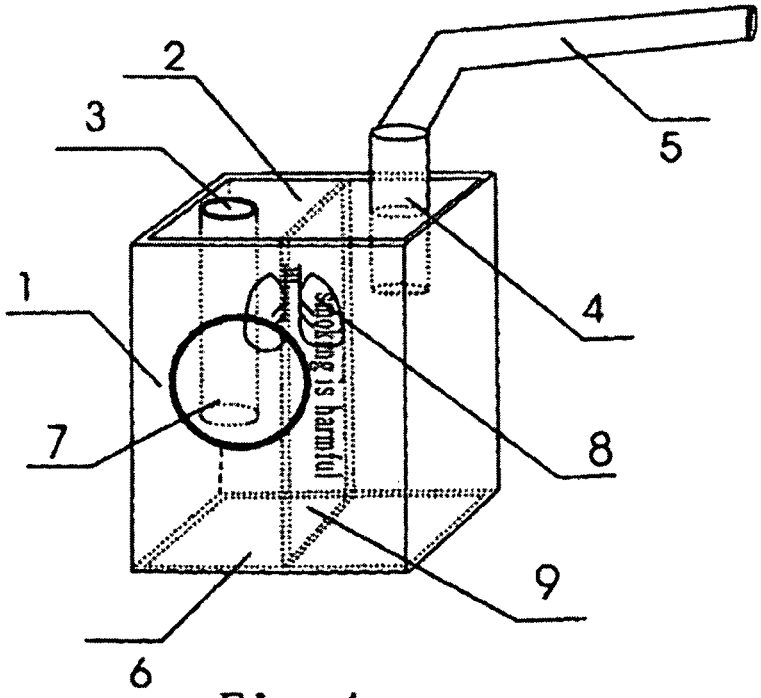
FIG. 4 is the perspective schematic diagram of the integral structure of the fourth recommendatory embodiment according to the present invention.

As shown in FIG. 4, the said assembly smoking cessation tobacco pipe with tiny holes comprises a box body part 1, a top cover part 2, a smoke-inlet pipe 3, a smoke-outlet pipe 4, a smoking pipe part 5, a bottom cover part 6, a convex lens 7 and a human lung's pattern 8, and an interlayer 9 is provided in the box body part 1. The interlayer 9 is arranged paralleling to the smoke-inlet pipe 3, and the around boundary of the interlayer are tightly fit with the box body part 1. A series of tiny holes on the interlayer 9 are the necessary route through which the smoke smog passing from the smoke-inlet pipe 3 to the smoke-outlet pipe 4, and the tiny holes may be arranged and assembled to form warning characters or patterns, which warning that smoking is harmful to health. In use, a cigarette is placed on the opening of the smoke-inlet pipe 3, and the smoker holds the smoking pipe part 5 between his lips to smoke. Smoke smog comes into the box body part 1 by the smoke-inlet pipe 3, and then passes through a series of tiny holes provided on the interlayer 9 and comes into the human body after passing through the smoke-outlet pipe 4 and the smoking pipe part 5. Because the smokers can clearly discern the phenomena that harmful ingredients such as tar in smoke smog are aggregated and adhered when they are smoking, and the warning characters or patterns on the interlayer which strongly warning smokers that smoking is harmful to health in version, the effect that making the smokers to fully and directly realize the harm of tobacco to the human body when they are smoking and the function of helping them to give up smoking and publicize smoking cessation can be achieved.

Figure 5:
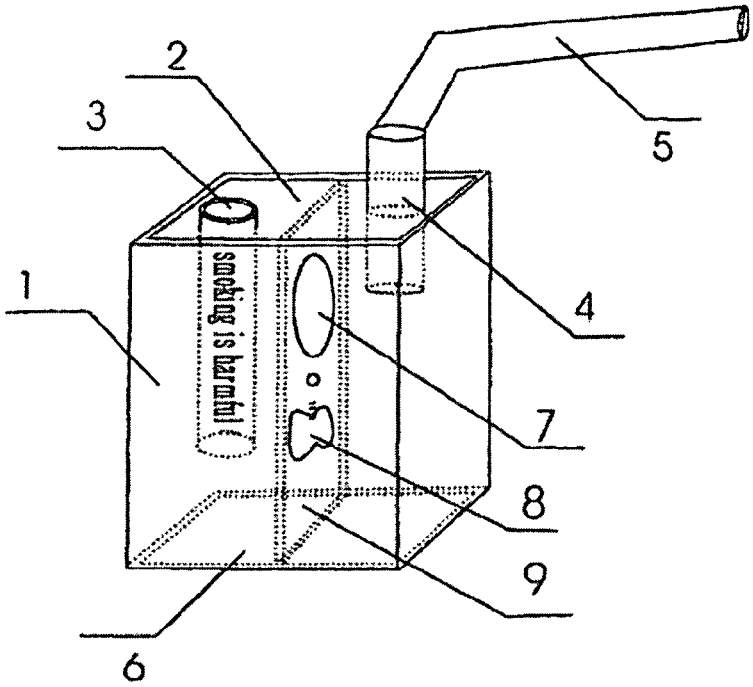
FIG. 5 is the perspective schematic diagram of the integral structure of the fifth recommendatory embodiment according to the present invention.

In the embodiment shown in FIG. 5, that a convex lens 7 and a human lung's pattern 8 provided on the box body part 1 are changed to be provided on the interlayer 9, which having the corresponding warning effect is, and herein the description is omitted.

Particularly, the present invention has many similar embodiments, for example, the interlayer in the box body part may be either parallel to the smoke-inlet pipe 3, or vertical to the smoke-inlet pipe 3; the box body part may be not hexahedral, but be cylindrical or multi-prism; the box bottom cover part may be integrated together with the box body part.

Figure 6:
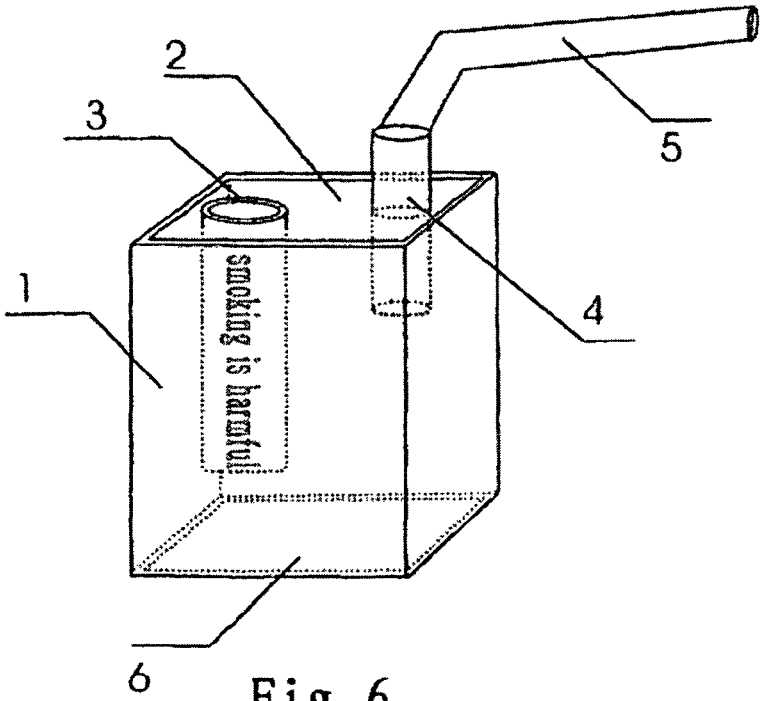
FIG. 6 is the perspective schematic diagram of the integral structure of the sixth recommendatory embodiment according to the present invention.
Figure 7:
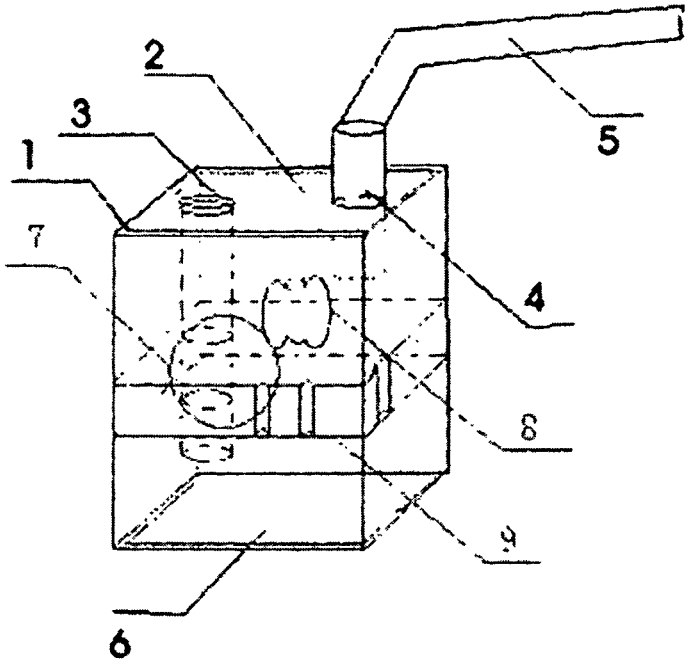
FIG. 7 is the perspective schematic diagram of the integral structure of the seventh recommendatory embodiment according to the present invention.

Although the present invention has been in detail described with reference to illustrative embodiments, it should be understood by those skilled in the art that numerous of other modifications, improvements and equivalents substitution of the technical solution of the present invention can be made. The embodiment shown in FIG. 6 is an equivalent substitution. As shown in FIG. 6, a series of tiny holes on a smoke-inlet pipe 3 are connected to each other to form hollowed-out warning characters or hollowed-out warning patterns, which warning that smoking is harmful to health, which has a corresponding warning effect. In addition, a series of tiny holes provided in the tobacco pipe may be either directly formed, or formed by clearance fit between parts. Hereafter, the embodiment that a series of tiny holes are provided on the interlayer is described with reference to FIG. 7. As shown in FIG. 7, the interlayer 9 is provided vertically to the smoke-inlet pipe 3 in the box body part 1. the smoke-inlet pipe 3 passes through the interlayer 9, the around boundary of the interlayer 9 are tightly fit with the box body part 1. On the surface which contacted with a box body part 1, there are a series of little grooves. There have no smog route else on the interlayer 9 except the said series of little grooves on the interlayer 9, and the series of little grooves are the only route through which the smoke smog passing and then getting into the smoke-outlet pipe 4 from the smoke-inlet pipe 3. The flow rate of smoke smog will change when the smog passes through the little grooves, the adhesive rises and the tar aggregating phenomena is more obvious. The purpose and effect of providing such series of little grooves are consistent with those of the series of tiny holes provided in the tobacco pipe.

What is claimed is:

1. A smoking cessation tobacco pipe, the whole of which is transparent, and which is assembled with a top cover part integrated with a smoke-inlet pipe and a smoke-outlet pipe, a box body part, a bottom cover part and a smoking pipe part, wherein the smoke-outlet pipe is connected with the smoking pipe part, and when in use the tobacco is placed at the opening of the smoke-inlet pipe, characterized in that in the box body part, a series of tiny holes are provided on a smog route from the smoke-inlet pipe to the smoke-outlet pipe, where the tiny holes are arranged and assembled to form warning characters or patterns, which warn that smoking is harmful to health.

2. The tobacco pipe according to claim 1, characterized in that a convex lens and a pattern of human's lung are provided in the box body part.

3. The tobacco pipe according to claim 1, characterized in that the said tiny holes are provided on the smoke-inlet pipe or the smoke-outlet pipe.

4. The tobacco pipe according to claim 1, characterized in that there is an interlayer in the box body, the wherein tiny holes are provided on said interlayer.

5. The tobacco pipe according to claim 1, characterized in that there is an interlayer in the box body, wherein said interlayer is provided with a convex lens and a pattern of human's lung.

6. The tobacco pipe according to claim 1, characterized in that the top cover part of the tobacco pipe is provided with a convex lens and a pattern of human's lung.

7. The tobacco pipe according to claim 1, characterized in that the bottom cover part of the tobacco pipe is provided with a convex lens and a pattern of human's lung.

8. The tobacco pipe according to claim 1, characterized in that said tiny holes are either independent to each other or connected to each other so as to form hollowed-out warning characters or hollowed-out warning patterns, which warn that smoking is harmful to health.

9. The tobacco pipe according to claim 1, characterized in that said tiny holes may be directly integrated, or may be formed by clearance fit between the parts.

* * * * *